United States Patent [19]

Baloche

[11] Patent Number: 5,074,076

[45] Date of Patent: Dec. 24, 1991

[54] GLASS LIFTING DEVICE MORE PARTICULARLY FOR AUTOMOBILE VEHICLES

[75] Inventor: Francois Baloche, Orne, France

[73] Assignee: Bertrand Faure Automobile, Yvelines, France

[21] Appl. No.: 635,842

[22] Filed: Dec. 31, 1990

[30] Foreign Application Priority Data

Feb. 16, 1990 [FR] France ..... 90 01900

[51] Int. Cl.[5] ..... E05F 11/44

[52] U.S. Cl. ..... 49/351

[58] Field of Search ..... 49/348, 349, 350, 351

[56] References Cited

U.S. PATENT DOCUMENTS

| | | | |
|---|---|---|---|
| Re. 16,380 | 7/1926 | Gates | 49/351 |
| 2,391,073 | 12/1945 | Rappl | 49/349 X |
| 2,616,688 | 11/1952 | Floraday | 49/350 |
| 3,072,395 | 1/1963 | Pickles | 49/351 X |
| 3,193,275 | 7/1965 | Krueger | 49/351 |
| 3,532,005 | 10/1970 | Bremner et al. | 49/349 X |
| 4,069,616 | 1/1978 | Doveinis | 49/351 X |
| 4,221,079 | 9/1980 | Becker | 49/351 |
| 4,414,779 | 11/1983 | Ishii | 49/349 X |
| 4,550,529 | 11/1985 | Drouillard | 49/351 X |
| 4,640,051 | 2/1987 | Maier et al. | 49/348 |
| 4,794,733 | 1/1989 | Kanemaru | 49/348 |

*Primary Examiner*—Rodney M. Lindsey
*Assistant Examiner*—Jerry Redman
*Attorney, Agent, or Firm*—Robert W. Becker & Associates

[57] ABSTRACT

A platen is fixed onto an armature of a vehicle door and carries a shaft for rotation of a toothed sector about a first pin. A lower portion of the toothed sector extends in the form of a first toothed half-moon cooperating with a second half-moon mounted on a second pin. The first and second pins support a set of arms and a spindle is rigidly connected to each of the half-moons for driving in rotation each of the arms. The pins have a front face which is inclined and forms an angle with respect to a vertical surface of the platen. The arms are arranged in planes enabling an appropriate guiding in height (lifting and lowering) of a curved glass of the vehicle door.

4 Claims, 2 Drawing Sheets

GLASS LIFTING DEVICE MORE PARTICULARLY FOR AUTOMOBILE VEHICLES

BACKGROUND OF THE INVENTION

The present invention relates to a glass or window lifting device which can be used in doors of various vehicles, whatever the design of the carriage body of this vehicle.

It should first be recalled that till now, the glass or window lifting devices of the door of vehicles which included a set of arms were divided into two main sections, namely:

the glass or window lifting devices with rigid arms for glasses of plane doors, the glass lifting devices with flexible arms for glasses of curved doors thereby enabling due to their flexibility, a following of the curvature of the lateral glass guides.

When these solutions cannot be used, it is necessary to use, in the doors of automobile vehicles, driving mechanisms for lifting or lowering the window glasses which include assemblies of cables with return pulleys, or assemblies of offset spiral springs for driving the window upwardly or downwardly via pinions meshing with turns of each spring.

The above description, which pertains to the prior art, shows obviously that it was necessary each time to make a particular study of the device since no solution was a standard solution. Where flexible arms were used, a resistance due to the flexion of the arms was felt on account of the torque thus created which was acting on the control crank. In the case of cables or push springs, the guiding operation was very hazardous because of the fixation points, either of the cable or of the spring, on a center of the glass or at a lower end of the glass support.

The present invention remedies this disadvantage by providing a glass lifting device which very easily adapts itself to all cases.

SUMMARY OF THE INVENTION

According to the invention, the glass lifting device comprises a platen fixed on an armature of a respective vehicle door and carries, at one of its ends, a shaft for rotation of a pinion which meshes with a toothing of a sector causing a rotation about a pin of this sector, this sector being extended, at a lower portion, by a toothed half-moon for cooperating with a toothing of another toothed half-moon also mounted on a pin, these two pins being placed in a same horizontal plane perpendicular to the platen for supporting a set of arms, a driving in rotation of these arms being provided for each of the arms by a spindle rigidly connected to the toothed half-moons, and finally a front face of the pins is inclined by an angle $\alpha$ with respect to a vertical surface of the platen, whereby the arms are arranged in planes for an appropriate guiding in height (lifting and lowering) of a curved glass of the vehicle door.

Various other features of the invention will become more apparent from the following detailed description.

BRIEF DESCRIPTION OF THE DRAWINGS

An embodiment of the invention is shown, by way of a non limiting example, in the accompanying drawings.

DESCRIPTION OF PREFERRED EMBODIMENTS

Figure 1:
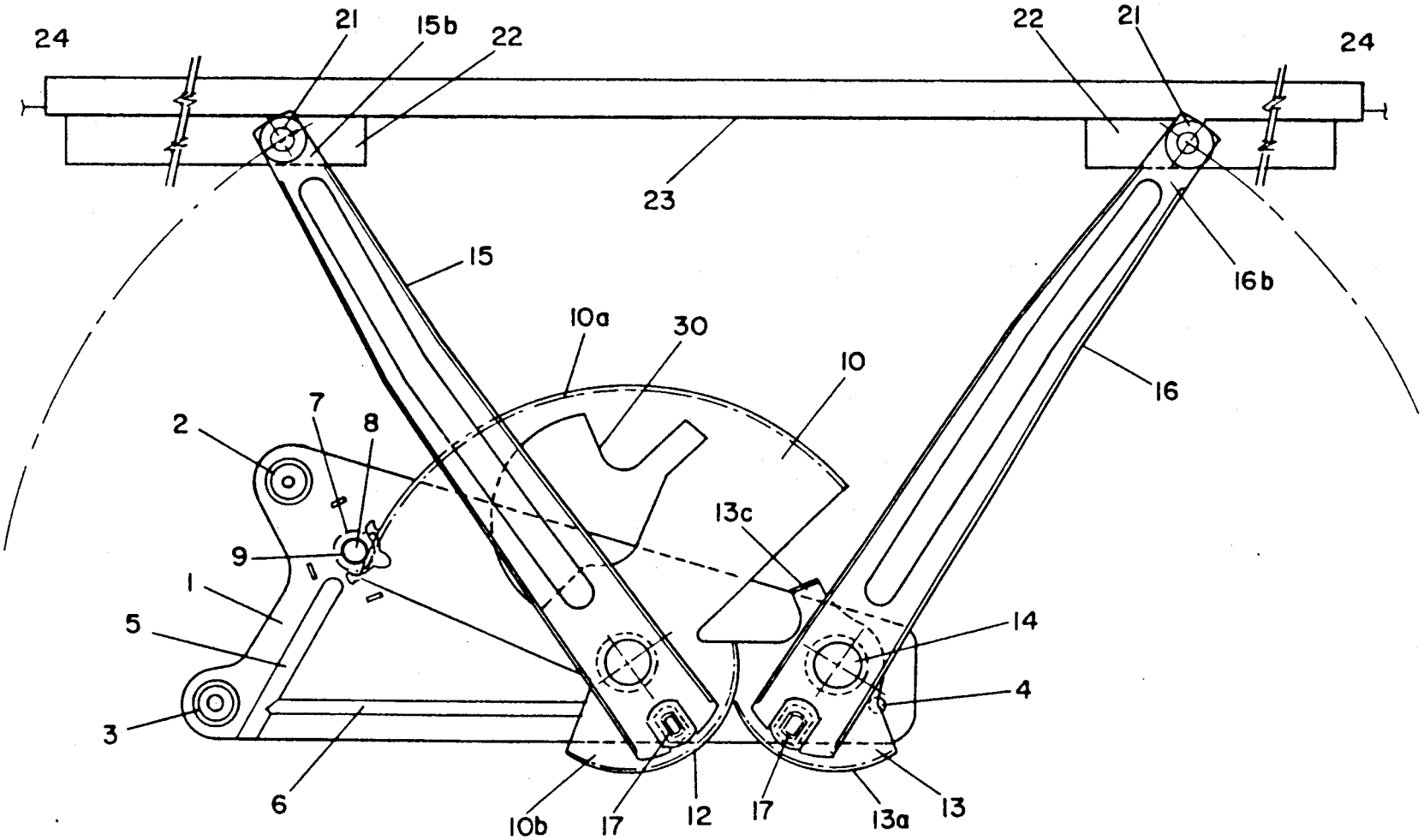
FIG. 1 is a front elevation view of the glass lifting device according to the invention.

Referring now to FIG. 1, a platen 1 substantially in the shape of a rectangular trapezium is fixed at 2, 3, 4 on an inner armature of a vehicle door. This platen 1, which is rigidified by embossed lines 5, 6, carries a bearing member 7 in which can rotate a shaft 8 driving a pinion 9 which meshes normally with a toothing 10*a* of a toothed sector 10 mounted on a pin 11 that is rigidly connected to the platen 1. The toothed sector 10 is extended, at its lower portion, by a semi-circular half-moon 10*b* having a toothing 12 so as to cooperate with a toothing 13*a* of a second toothed half-moon 13 that has the same diameter as the toothed half-moon 10*b* and has at its periphery a toothing 13*a* identical to the toothing 12.

Thus, when the pinion 9 is driven by means of the shaft 8, the pinion 9 imparts, by meshing with the toothing 10*a* of the toothed sector 10, a rotary motion of the toothed sector 10 about the fixed pin 11. The rotary motion drives the half-moon 10*b* half-moon 13, which is mounted on a fixed pin 14 rigidly connected to the right hand side portion of the platen 1.

Figure 4:
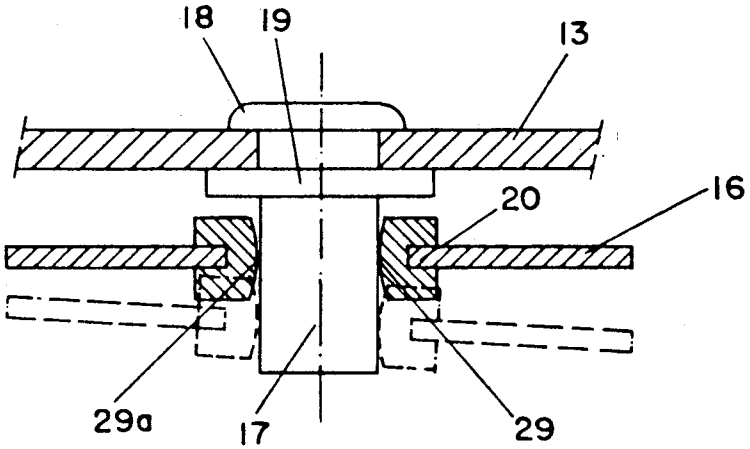
FIG. 4 is an enlarged cross-sectional view of one of the members of the glass lifting device.
Figure 3:
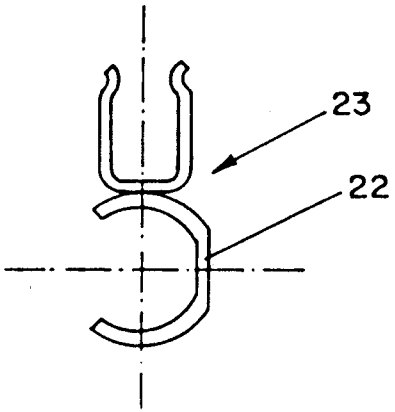
FIG. 3 shows an enlarged detail of the device for maintaining the glass on the lifting arm.

Arms 15, 16 are mounted on the pins 11 and 14, the arm 15 being connected to the half-moon 10*b* and the arm 16 being connected to the half-moon 13. The junction between the pins 15 and 16 and the half-moons 10*b*, 13 is effected by means of spindles 17 fixed on the outer periphery of the half-moons 10*b*, 13 via means of two plates 18, 19 (see FIG. 4). The spindles 17 have in cross-section a shape which is substantially rectangular, and they are connected to the bottom of the arms 15, 16 by means of rings 29 introduced inside holes 20 formed in the arms 15, 16.

Figure 2:
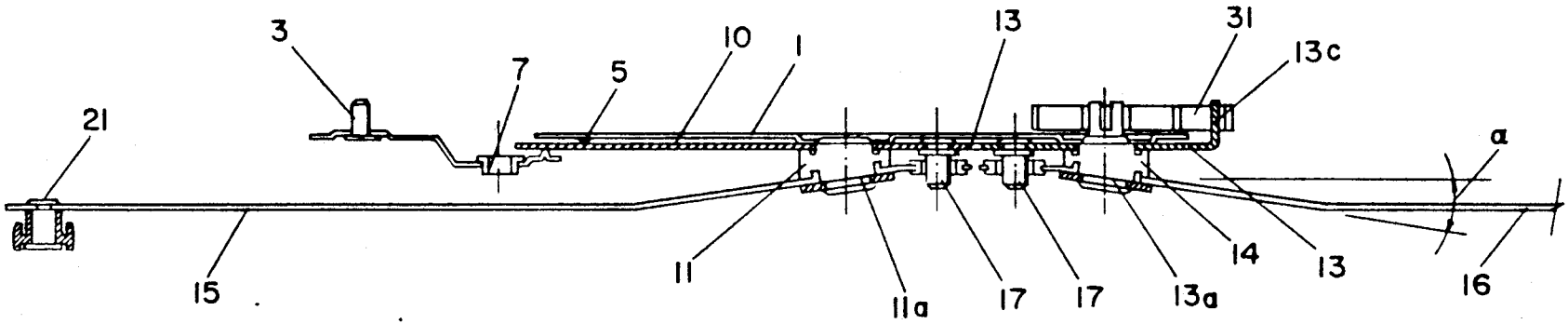
FIG. 2 is a plan view, partly in cross-section, corresponding to FIG. 1.

The rings 29 are generally made of a plastic material, and more especially of a synthetic having lubricating properties material. The rings have a central opening 29*a* with a hemispherical edge so as to facilitate their introduction on the spindles 17 and, also, to provide a slight clearance so that the arms 15, 16 will occupy a position adapted to the curvature of glasses of the vehicle door; this being completed by the fact that the fixed pins 11 and 14 have in cross-section (see FIG. 2) a shape of a rectangular trapezoid, the front faces 11*a*, 13*a* of each of which is inclined at an angle (see FIG. 2) corresponding there again to the curvature of the glass in question. In general, the pins 11 and 14 are made of a cast material and the angle is between 1° and 25°, and preferably between 6° and 15.

Finally, the upper end 15*b*, 16*b* of the arms 15, 16 carries rollers 21, with the rollers 21 sliding inside guides 22 (see FIG. 1). A U-shaped clamp 23 is provided for maintaining the curved glass 24 in consideration rigidly on the arms 15, 16.

The shaft 8 which carries the pinion 9 can be motorized in some cases.

As may be seen easily in FIG. 1, the upper end 13*c* of the half-moon 13 is bent at a right angle so as to limit the movement of the half-moons 10*b*, 13 in order to allow a maximum lowering of the respective window and also to avoid a disengagement of the cooperating toothings 12 and 13*a* of these two half-moons 10*b*, 13. Moreover, there is provided a spiral spring 31 which, by acting on the end 13*c* of the half-moon 13, balances the forces of reaction of the mechanical assembly forming the glass lifting device.

It should also be pointed out that the toothed sector 10 can be cut out, for reasons of economy, by any convening means in the central portion of the sector 10, thereby making the sector 10 lighter due to a corresponding opening 30 (see FIG. 1).

The present invention is, of course, in no way restricted to the specific disclosure of the specifiation and drawings, but also encompasses any modifications within the scope of the appended claims.

What I claim is:

1. A glass lifting device especially for an automobile vehicle having a vehicle door with an armature, comprising:

a platen that is fixed onto said armature of said vehicle door and carries, at one end thereof, a shaft for rotation of a pinion meshing with a toothing of a toothed sector;

a first pin being rigidly connected to said platen for rotation of said sector about said first pin, said sector having an extension at a lower portion thereof in the form of a toothed half-moon provided with a first toothing for cooperating with a second toothing of a second half-moon;

a second pin being rigidly connected to said platen for rotation of said second half-moon;

said first and said second pin supporting a respective first and second arm and being placed in a common horizontal plane perpendicular to a plane of said platen which is positioned in a vertical arrangement relative to said vehicle door;

a first spindle being rigidly connected to said first half-moon and a second spindle being rigidly connected to said second half-moon for driving each of said arms to rotate same about said respective first and second pins; and said first and said second pins having a front face which is inclined and forms an angle with respect to said vertical of said platen that said arms are arranged in a plane enabling an appropriate guiding for lifting and lowering of a curved glass of said vehicle door.

2. A glass lifting device according to claim 1, wherein said first and second pins have a rectangular trapezoidal cross-section, with said inclined front faces having said angle with respect to a respective rear face thereof that is adapted for being parallel to a vertical plane defined by said platen, said pins being made of any convenient material.

3. A glass lifting device according to claim 2, wherein said pins are made of a cast material.

4. A glass lifting device according to claim 2, wherein said angle is between 1° and 25°.

* * * * *